US006948951B2

(12) United States Patent
Wu et al.

(10) Patent No.: US 6,948,951 B2
(45) **Date of Patent: *Sep. 27, 2005**

(54) ELECTRICAL CONNECTOR ASSEMBLY HAVING CONTACTS CONFIGURED FOR HIGH-SPEED SIGNAL TRANSMISSION

(75) Inventors: Min-Fang Wu, Tu-Chen (TW); Hüng-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/927,251

(22) Filed: Aug. 25, 2004

(65) Prior Publication Data

US 2005/0148226 A1 Jul. 7, 2005

Related U.S. Application Data

(63) Continuation of application No. 10/329,022, filed on Dec. 23, 2002, now Pat. No. 6,783,400.

(51) Int. Cl.[7] ..... H01R 17/00
(52) U.S. Cl. ..... 439/108; 439/608; 439/660
(58) Field of Search ..... 439/660, 676, 439/941, 404, 344, 405, 409, 417, 608–609, 439/108, 803, 778, 788

(56) References Cited

U.S. PATENT DOCUMENTS

| | | | | |
|---|---|---|---|---|
| 5,083,238 A | | 1/1992 | Bousman | |
| 5,915,976 A | | 6/1999 | McHugh | |
| 6,033,236 A | * | 3/2000 | McHugh et al. | 439/74 |
| 6,042,398 A | * | 3/2000 | Wu et al. | 439/101 |
| 6,095,824 A | * | 8/2000 | McHugh | 439/74 |
| 6,129,589 A | * | 10/2000 | Simmel et al. | 439/660 |
| 6,155,886 A | * | 12/2000 | Koseki et al. | 439/736 |

* cited by examiner

*Primary Examiner*—Gary Paumen
*Assistant Examiner*—Phuongchi Nguyen
(74) *Attorney, Agent, or Firm*—Wei Te Chung

(57) ABSTRACT

An electrical connector assembly (1) includes a first connector (2) and a second connector (3). The first connector includes a first housing (21) and first electrical contacts (22). The second connector includes a second housing (31) and second electrical contacts (32). The first contacts include signal contacts (22A), ground contacts (22B), and shield-joint contacts (22C). The signal contacts are arranged in pairs, with each pair transmitting one set of differential signals. The signal contacts within each pair are separated by an empty passage (214). Adjacent pairs of signal contacts are separated by one ground contact or by one shield-joint contact. The second contacts are configured to correspond to the first contacts, so that the first and second contacts can electrically mate with each other to electrically interconnect the first and second connectors. The wide interval between adjacent signal contacts enables cross talk between adjacent signal contacts to be reduced.

12 Claims, 7 Drawing Sheets

ELECTRICAL CONNECTOR ASSEMBLY HAVING CONTACTS CONFIGURED FOR HIGH-SPEED SIGNAL TRANSMISSION

CROSS-REFERENCE TO RELATED APPLICATIONS

This is a continuation application of a copending patent application Ser. No. 10/329,022, filed Dec. 23, 2002, now U.S. Pat. No. 6,783,400.

BACKGROUND OF THE INVENTION

1. Field of the Invention

The present invention relates to electrical connector assemblies, and more particularly to a connector assembly having two mating connectors used for high-speed signal transmission.

2. Description of Related Art

High-speed digital electronic apparatus, such as certain communication equipments and computer servers, require fast and accurate signal transmission. These apparatus have electronic components including connectors, wires, circuit boards, and integrated circuit packages. In low-speed applications, these components can function normally in cooperation with each other. However, in high-speed applications, conductivity and other electrical characteristics of these components become critical in ensuring that the electrical performance of the apparatus as a whole is satisfactory.

The faster the signal transmission required of an electronic apparatus, the harder it is to build suitable electrical connectors for the apparatus. One of the primary electrical factors affecting high-speed performance in connectors is cross talk mutually induced between two adjacent contacts of the connector. The intensity of cross talk depends on the distance between the two adjacent contacts.

Today, as electrical products become smaller and smaller, so too do their components such as connectors. In addition, the number of contacts in contemporary connectors is increasing due to the demand for more signal transmission paths and faster transmission speeds. Therefore, the distance between adjacent contacts inside a typical connector is becoming less and less. Cross talk induced between the contacts is becoming increasingly significant, and needs to be carefully addressed.

One way to deal with cross-talk inside a connector is to establish a ground reference means between every two contacts of the connector. U.S. Pat. No. 5,645,436 shows an example of a conventional connector system including jack and plug connectors. Each connector includes a plurality of signal contacts arranged in several rows and columns in an electrically insulative body. Signal paths comprising mutually engaged contacts of the jack and plug connectors have ground means alternately located therebetween. As a result, the number of contacts installed inside the jack and plug connectors is increased. In addition, manufacturing of the ground means and signal contacts becomes significantly complicated due to the different structural designs of the signal contacts and ground means. Furthermore, the increased number of contacts results in more difficulty when installing the contacts into the connector housing, because only a smaller pitch between every two adjacent receiving holes in the housing is available. These difficulties in manufacturing increase costs significantly, and do not necessarily guarantee better electrical performance.

Another way to deal with cross talk is to transmit differential signals in a connector, as described in the book High-Speed Digital Design (by Howard W. Johnson and Martin Graham, pp. 319–320). Such connector can provide better electrical performance with regard to impedance matching, cross talk reduction, and electromagnetic interference (EMI) reduction. What is needed is an electrical connector transmitting differential signals, which can overcome the above-described shortcomings of conventional connectors.

SUMMARY OF THE INVENTION

It is therefore an object of the present invention to provide an electrical connector assembly for high-speed signal transmission which has a simplified structure and enhanced electrical performance.

To achieve the above object, an electrical connector assembly of the present invention is provided to electrically connect two printed circuit boards. The connector assembly includes a first board-to-board connector and a second board-to-board connector mounted on the two printed circuit boards respectively. The first connector comprises a first insulative housing receiving a multiplicity of first contacts. The second connector comprises a second insulative housing receiving a multiplicity of second contacts. The first housing comprises an insulative mating part, and a multiplicity of first contact-receiving passages defined therein. The first passages are arranged along two opposing lengthwise sides of the mating part, and receive the first contacts therein. The second housing defines a mating groove corresponding to the mating part of the first connector. The second contacts are positioned at two lengthwise sides of the mating slot, and correspond to complementarily mating first contacts of the first connector. Thus the first and second contacts can electrically mate with each other to electrically interconnect the two printed circuit boards.

In a first preferred embodiment of the invention, the first contacts comprise a plurality of first signal contacts, a plurality of first ground contacts, and a plurality of first shield-joint contacts.

The first contacts are arranged in the first passages, and divided into several successively arranged groups. In each group, there are two pairs of first signal contacts. Each pair of first signal contacts transmits one set of differential signals. Each pair of first signal contacts is installed in the first passages almost adjacent the other pair of first signal contacts, with one first shield-joint contact separating the two pairs of first signal contacts. A first passage between first signal contacts of the same pair is empty. Two first ground contacts are installed in two of the first passages at respective opposite ends of the group of first contacts.

The second contacts are arranged in the second passages corresponding to the respective first contacts. The second contacts comprise a plurality of second signal contacts, a plurality of second ground contacts, and a plurality of second shield-joint contacts. The second signal contacts are paired corresponding to the first signal contacts.

Due to the wide interval between adjacent signal contacts, cross-talk between adjacent signal contacts can be reduced. In addition, the signal contacts are well shielded by the ground contacts and the shield-joint contacts. This significantly facilitates suppression of any EMI noise emanating from these signal transmission paths. Furthermore, because the distances between the paired signal contacts is increased, the impedance of the first and second connectors increases at the same time in order to match impedance of the signal circuitry at other electronic components along the same signal transmitting paths.

In a second preferred embodiment of the invention, the empty passage within each pair of signal contacts is not present. A distance between adjacent passages receiving a pair of signal contacts is twice as long as a distance between any other adjacent passages. In a third preferred embodiment of the invention, a first passage between first signal contacts of the same pair has a spare contact that is not used to transmit any signals.

Other objects, advantages and novel features of the present invention will be drawn from the following detailed description of the preferred embodiments of the present invention with the attached drawings, in which:

DETAILED DESCRIPTION OF THE INVENTION

Figure 1:
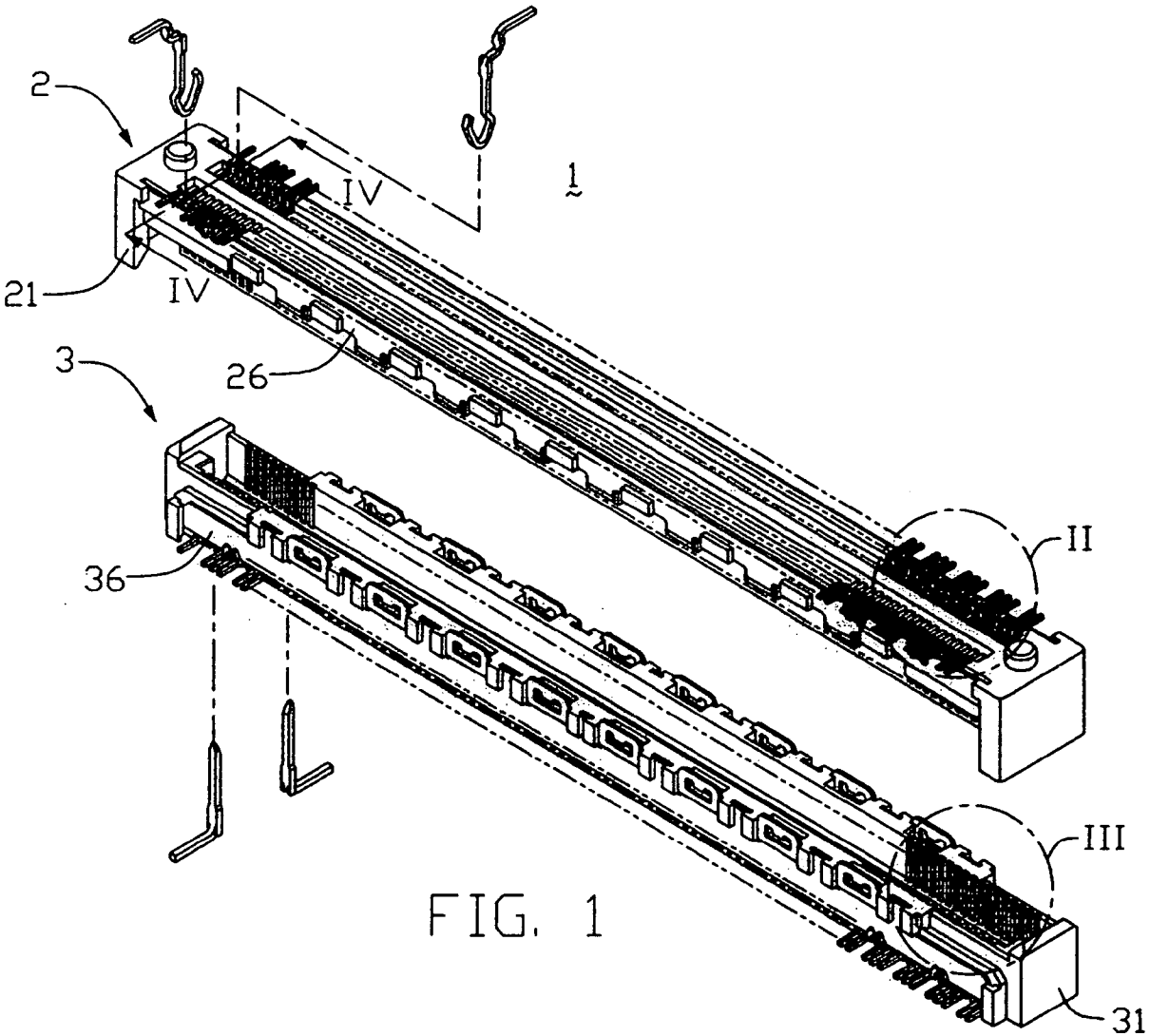
FIG. 1 is a simplified, exploded isometric view of an electrical connector assembly in accordance with a first preferred embodiment of the present invention, showing a first connector and a second connector respectively with contacts installed therein.
Figure 2:
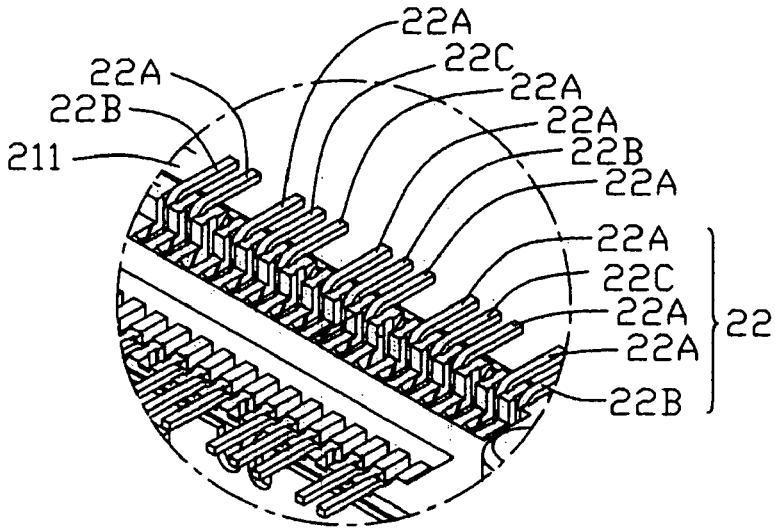
FIG. 2 is an enlarged view of a circled portion II of FIG. 1.
Figure 3:
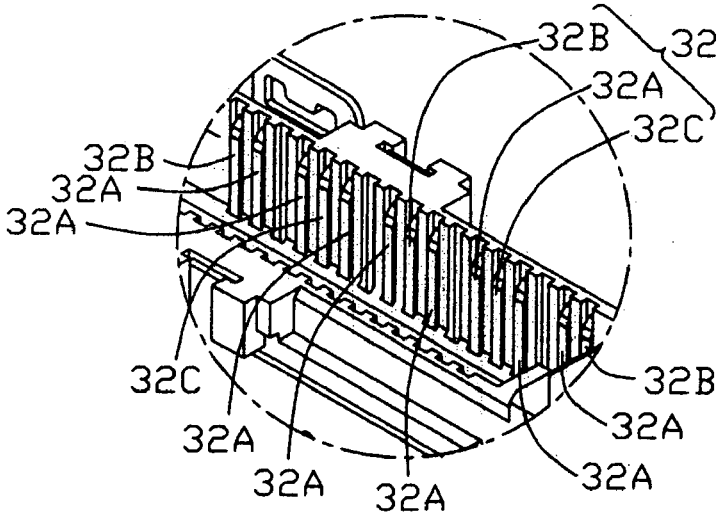
FIG. 3 is an enlarged view of a circled portion III of FIG. 1.
Figure 4:
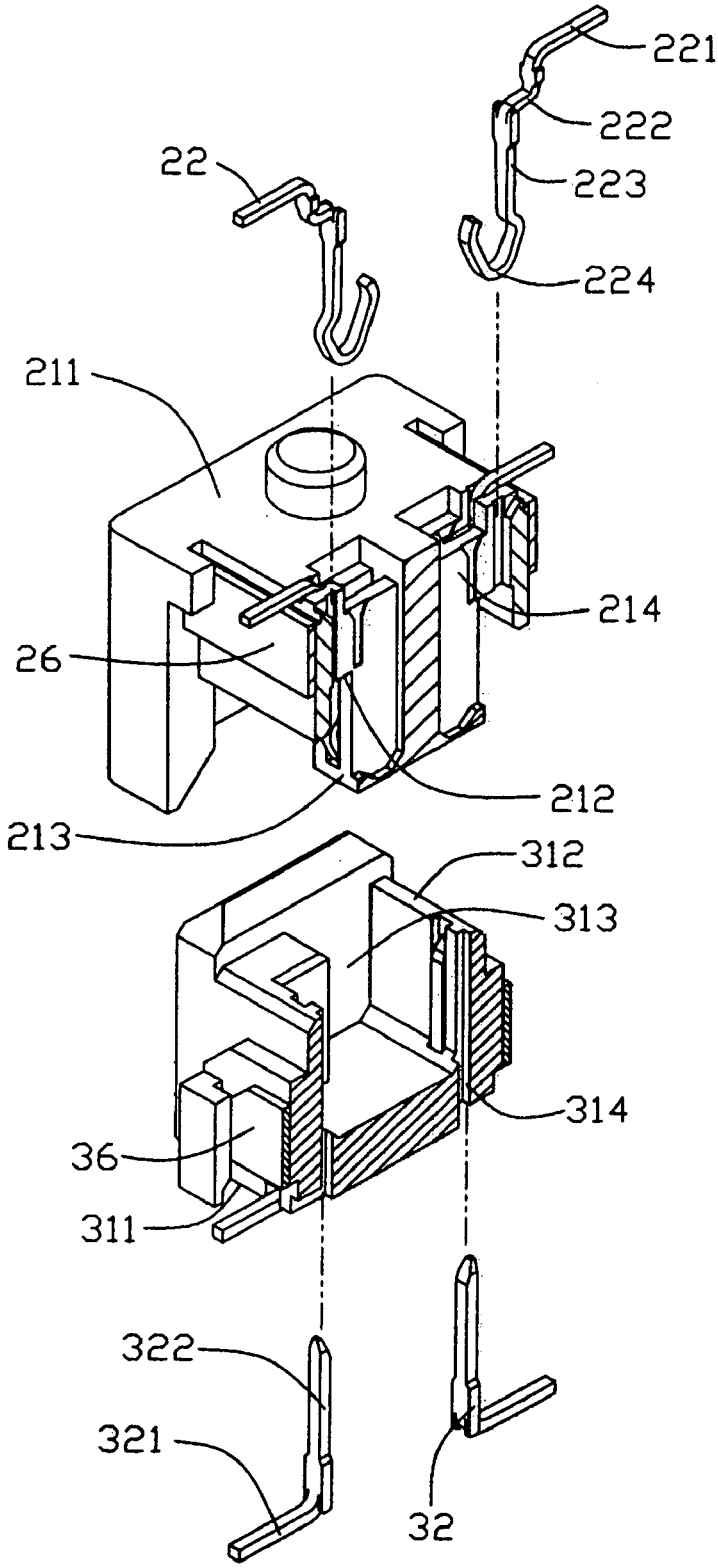
FIG. 4 is an enlarged, isometric sectional view of the electrical connector assembly of FIG. 1, taken along line IV—IV of FIG. 1.

Reference will now be in detail to the preferred embodiments of the present invention.

It should be noted that for a better understanding of the invention, most like components are designated by like reference numerals throughout the various figures of the embodiments. Referring to FIGS. 1 to 4, an electrical connector assembly 1 in accordance with a first preferred embodiment of the present invention includes a first board-to-board connector 2 and a second board-to-board connector 3 adapted to mate with each other.

The first connector 2, a receptacle one of the assembly, includes a first insulative housing 21 receiving a multiplicity of first contacts 22, and two first shield plates 26 separately attached on each of two lengthwise exterior surfaces of the first housing 21. The first housing 21 defines a first mounting surface 211 seated on a printed circuit board (not shown), and a first mating surface 212 opposite to the first mounting surface 211 and facing toward the second connector 3. An elongated mating part 213 is formed along a lengthwise central portion of the first mating surface 212, and is surrounded on three sides by a U-shaped slot. The mating part 213 includes a multiplicity of first contact-receiving passages 214 defined therein, the first passages 214 being arranged along two opposing lengthwise sides of the mating part 213 at equal intervals. Each first passage 214 has two openings. One opening communicates with the slot, and the other opening is located at the first mounting surface 211.

Each first contact 22 includes a tail portion 221, a fixing portion 222, a joint portion 223, and an engaging portion 224. The first contacts 22 comprise three types: first signal contacts 22A, first ground contacts 22B, and first shield-joint contacts 22C. The first signal contacts 22A are used to transmit desired signals for the first connector 2. The first ground contacts 22B are grounded when they are attached to the printed circuit board. Finally, the first shield-joint contacts 22C are usually grounded and electrically engaged with a corresponding first shield plate 26.

The first contacts 22 are arranged in the first passages 214, and divided into several successively arranged groups. Each group of first contacts 22 includes seven contacts: four first signal contacts 22A, two first ground contacts 22B, and one first shield joint contact 22C. The four first signal contacts 22A are paired as two differential signal transmission paths. Each pair of first signal contacts 22A is installed in the first passages 214 almost adjacent the other pair of first signal contacts 22A, with only the shield-joint contact 22C being located in a centermost first passage 214 separating the two pairs of first signal contacts 22A. A first passage 214 between first signal contacts 22A of the same pair is empty. The two first ground contacts 22B are installed in two of the first passages 214 at respective opposite ends of the group of first contacts 22.

Each group of first contacts 22 has the same arrangement of first contacts 22 therein as described above. Each two adjacent groups of first contacts 22 overlap at one first ground contact 22B. That is, each two adjacent groups of first contacts 22 share the first ground contact 22B that is located at a common end of the two adjacent groups of first contacts 22. Due to the empty first passages 214, signal noise can be reduced for each differential first signal contact pair 22A. Thus stable high-frequency signal transmission can easily be achieved by the contact arrangement of the first connector 2.

The second connector 3, a plug one of the assembly, includes a second insulative housing 31, a multiplicity of second contacts 32 received in the second housing 31, and two second shielding plates 36 separately attached on each of two lengthwise exterior surfaces of the second housing 31. The second housing 31 defines a second mounting surface 311 seated on a printed circuit board (not shown), and a second mating surface 312 opposite to the second mounting surface 311 and facing toward the first connector 2. A mating groove 313 is defined along a lengthwise central portion of the second mating surface 312. A multiplicity of pairs of second contact-receiving passages 314 is defined in opposite lengthwise walls of the housing 31 at the mating groove 313, corresponding to the first passages 214 of the first connector 2. Each second passage 314 has two openings. One opening communicates with the mating groove 313, and the other opening is located at the second mounting surface 311.

Each second contact 32 includes a mating portion 322 mating with a corresponding first contact 22, and a solder tail 321 perpendicular to the mating portion 322 and extending out of the second housing 31. The second contacts 32 comprise three types: second signal contacts 32A, second ground contacts 32B, and second shield-joint contacts 32C. These three types of second contacts 32 correspond to the above-described three types of first contacts 22. The second signal contacts 32A are used to transmit desired signals for the second connector 3. The second ground contacts 32B are grounded when they are attached to the printed circuit board. The second shield-joint contacts 32C are usually grounded and electrically engaged with a corresponding second shield plate 36.

The second contacts 32 are arranged in the second passages 314. The second signal contacts 32A are installed in the second passages 314 corresponding to the first signal contacts 22A. The second ground contacts 32B are installed in the second passages 314 corresponding to the first ground contacts 22B. The second shield-joint contacts 32C are installed in the second passages 314 corresponding to the first shield-joint contacts 22C. A second passage 314 between second signal contacts 32A of the same pair is empty, in like manner as described above in relation to the first signal contacts 22A.

Therefore, when the second connector 3 is mated with the first connector 2, all the signal contacts 22A, 32A are well shielded by the ground contacts 22B, 22C, 32B, 32C and by the first and second shielding plates 26, 36. This significantly facilitates suppression of any EMI noise emanating from these signal transmission paths. In addition, every signal contact 22A, 32A of its respective differential signal pair is further separated by an empty first or second passage 214, 314. The enlarged intervening space between respective adjacent signal contacts 22A, 32A reduces cross talk and improves their electrical performance.

Because the distance between each paired first signal contacts 22A is increased, the impedance of the first connector 2 increases at the same time in order to match impedance of the signal circuitry at other electronic components along the same transmitting path. Similar advantages are obtained for the second connector 3 having a similar arrangement of paired second signal contacts 32A.

Figure 5:
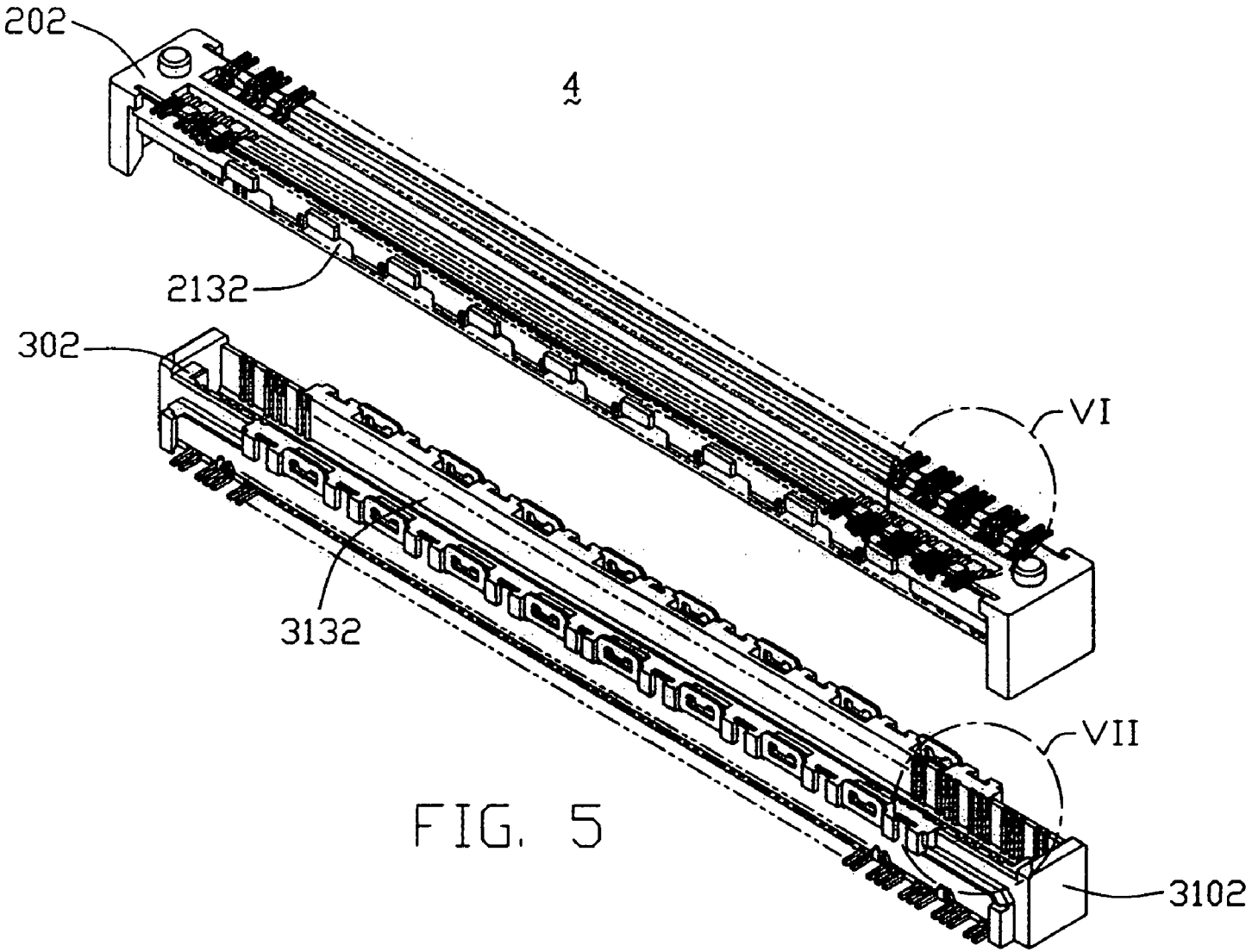
FIG. 5 is a simplified, exploded isometric view of an electrical connector assembly in accordance with a second preferred embodiment of the present invention, showing a first connector and a second connector respectively with contacts installed therein.
Figure 6:
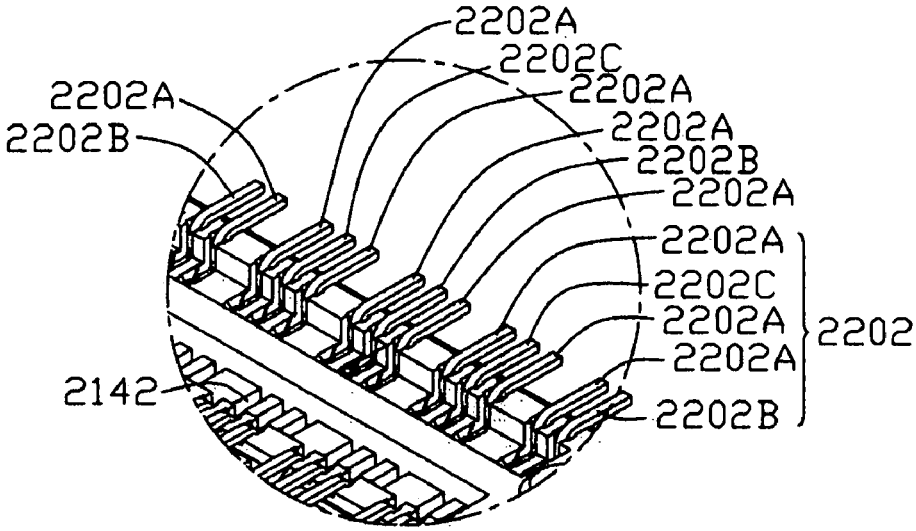
FIG. 6 is an enlarged view of a circled portion VI of FIG. 5.
Figure 7:
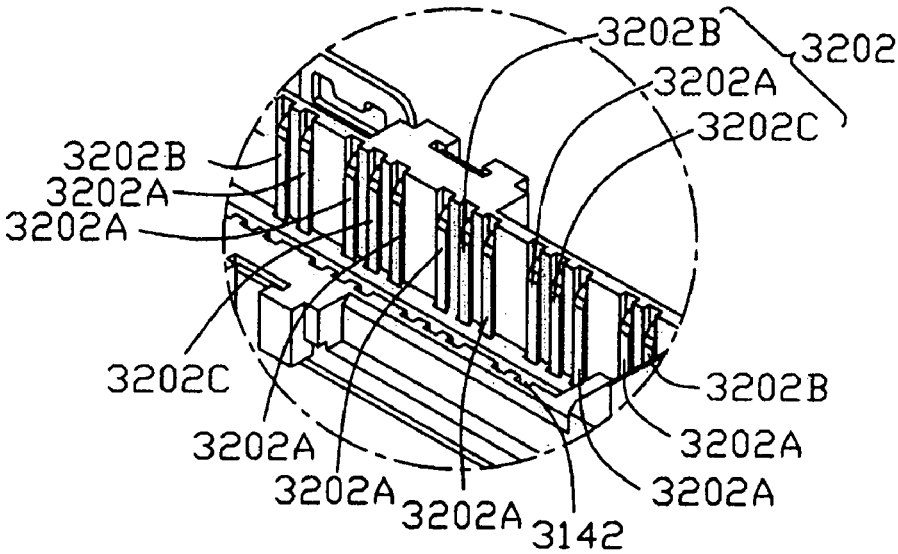
FIG. 7 is an enlarged view of a circled portion VII of FIG. 5.

Referring to FIGS. 5 to 7, an electrical connector assembly 4 in accordance with a second preferred embodiment of the present invention includes a first board-to-board connector 202 and a second board-to-board connector 302 adapted to mate with each other. An insulative mating part 2132 of the first connector 202 includes a multiplicity of first contact-receiving passages 2142 defined in opposite lengthwise sides of the mating part 2132.

First contacts 2202 comprise first signal, ground and shield-joint contacts 2202A, 2202B, 2202C arranged in the first passages 2142. The configuration of the second preferred embodiment is similar to the above-described configuration of the first preferred embodiment, except that the empty first passages 214 of the first preferred embodiment are not found in the mating part 2132 of the second preferred embodiment. A distance between adjacent first passages 2142 receiving a pair of first signal contacts 2202A is twice as long as a distance between any other adjacent first passages 2142.

A mating groove 3132 is defined in the second connector 302. A multiplicity of pairs of second contact-receiving passages 3142 is defined in opposite lengthwise walls of the second insulative housing 3102 at the mating grove 3132, corresponding to the first passages 2142 of the first connector 2112.

Second contacts 3202 are arranged in the second passages 3142. Second signal contacts 3202A installed in the second passages 3142 correspond to the first signal contacts 2202A. Second ground contacts 3202B installed in the second passages 3142 correspond to the first ground contacts 2202B. Second shield-joint contacts 3202C installed in the second passages 3142 correspond to the first shield-joint contacts 2202C.

Figure 8:
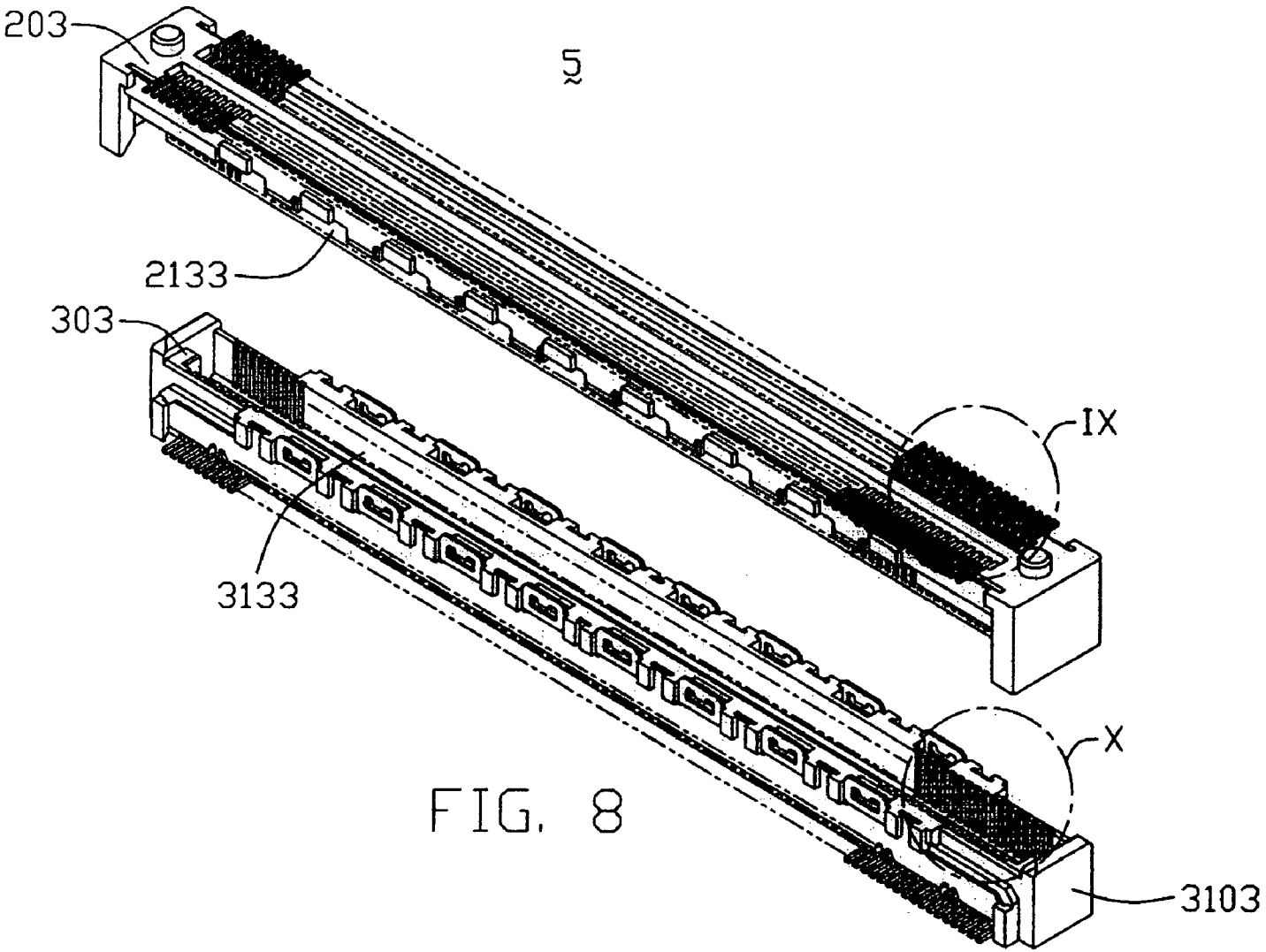
FIG. 8 is a simplified, exploded isometric view of an electrical connector assembly in accordance with a third preferred embodiment of the present invention, showing a first connector and a second connector respectively with contacts installed therein.
Figure 9:
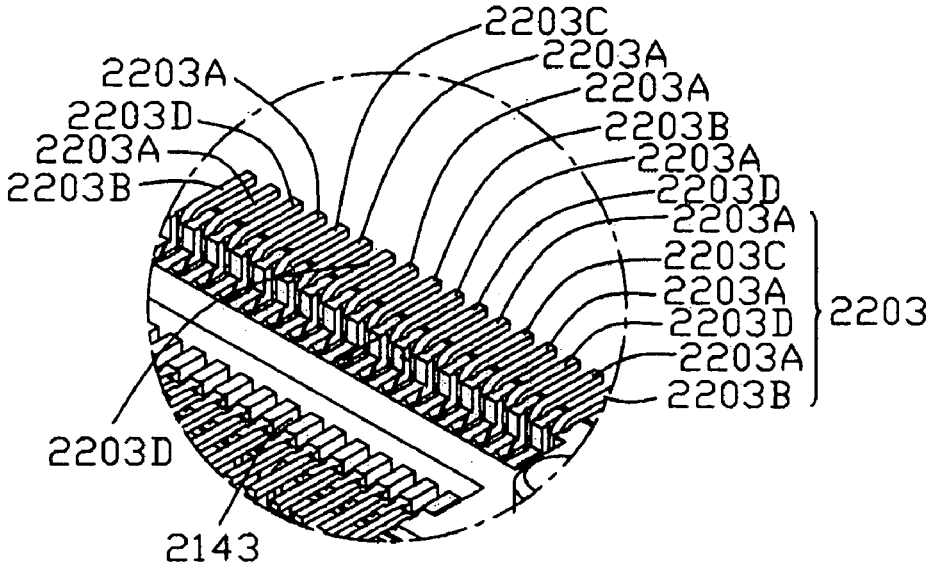
FIG. 9 is an enlarged view of a circled portion IX of FIG. 8.
Figure 10:
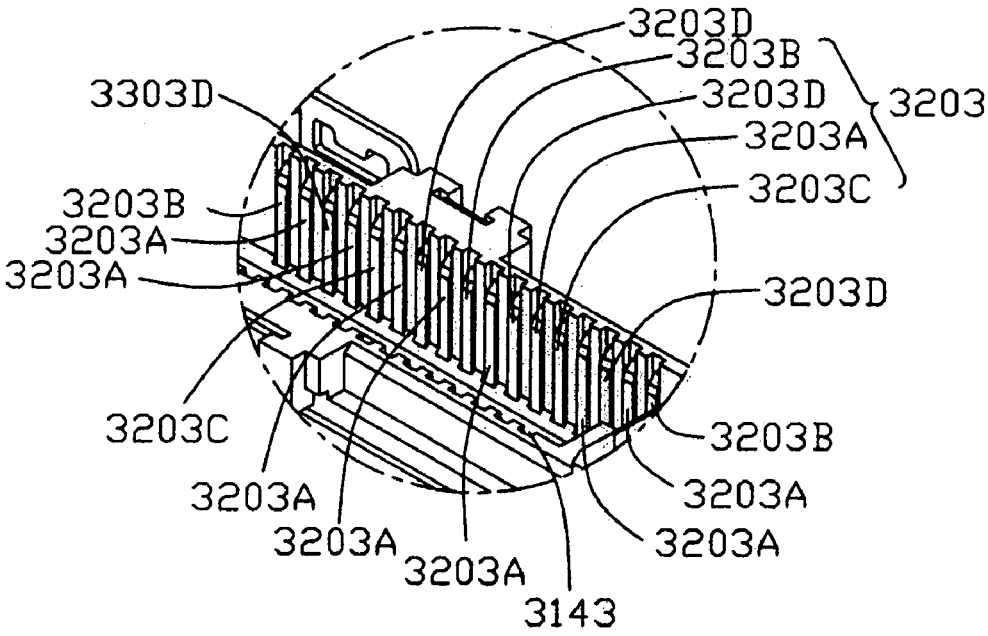
FIG. 10 is an enlarged view of a circled portion X of FIG. 8.

Referring to FIGS. 8 to 10, an electrical connector assembly 5 in accordance with a third preferred embodiment of the present invention includes a first board-to-board connector 203 and a second board-to-board connector 303 adapted to mate with each other. An insulative mating part 2133 of the first connector 203 includes a multiplicity of first contact-receiving passages 2143 defined in opposite lengthwise sides of the mating part 2133.

The first contacts 2203 comprise first signal, ground, shield-joint and spare contacts 2203A, 2203B, 2203C, 2203D. The spare contacts 2203D are not used to transmit any signals. The configuration of the third preferred embodiment is similar to the above-described configuration of the first preferred embodiment, except that the empty first passages 214 of the first preferred embodiment are replaced by the first passages 2143, with the first passages 2143 receiving the spare contacts 2203D.

A mating groove 3133 is defined in the second connector 303. A multiplicity of pairs of second contact-receiving passages 3143 is defined in opposite lengthwise walls of the second insulative housing 3103 at the mating groove 3133, corresponding to the first passages 2143 of the first connector 203.

Second contacts 3203 are arranged in the second passages 3143. Second signal contacts 3203A installed in the second passages 3143 correspond to the first signal contacts 2203A. Second ground contacts 3203B installed in the second passages 3143 correspond to the first ground contacts 2203B. Second shield-joint contacts 3203C installed in the second passages 3143 correspond to the first shield-joint contacts 2203C. Second spare contacts 3203D installed in the second passages 3143 correspond to the first spare contacts 2203D.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An electrical connector comprising:

an elongated insulative housing extending in a longitudinal direction;

a plurality of sets of contacts disposed in at least one side of the insulative housing along the longitudinal direction, each set of contacts comprising three adjacent contacts; wherein each set defines a first pitch internally between outermost contact and interim contact, every adjacent two sets defines a second pitch externally between two adjacent outermost contacts of the adjacent two sets, and the second pitch is larger than the first pitch;

wherein the outermost contacts of one set are used to transmit desired signals, and wherein the interim contact of the one set is grounded;

wherein the two outermost adjacent contacts of the adjacent two sets are used to transmit a differential pair of signals.

2. The electrical connector as claimed in claim 1, further comprising a metallic shell enclosing the insulative housing, and wherein the interim contact of at least one set electrically and mechanically connects with the metallic shell.

3. The electrical connector as claimed in claim 1, wherein the second pitch is twice of the first pitch.

4. An electrical connector assembly comprising:

a first connector comprising:

a first housing defining a longitudinal direction;

a plurality of pairs of first signal contacts disposed in at least one side of the housing along the longitudinal direction;

a plurality of first grounding contacts each being disposed between every two adjacent pairs of the first signal contacts;

a second connector for mating with the first connector, comprising:

a second housing defining a longitudinal direction;

a plurality of pairs of second signal contacts, electrically connecting with corresponding first signal contacts, disposed in at least one side of the housing along the longitudinal direction;

a plurality of second grounding contacts, electrically connecting with corresponding first grounding contacts, each being disposed between every two adjacent pairs of the second signal contacts; and wherein each connector defines a first pitch between the grounding contact and either of the two signal contacts adjacent thereto and a second pitch between two adjacent signal contact of two adjacent pairs, the first pitch is different from the second pitch.

5. The electrical connector assembly as defined in claim 4, wherein the second pitch is larger than the first pitch.

6. The electrical connector assembly as defined in claim 4, wherein the pair of signal contacts is used to transmit a differential pair of signals.

7. The electrical connector assembly as defined in claim 4, wherein the first connector further comprises a metallic shell enclosing the first housing, and wherein at least a grounding contact electrically and mechanically connects with the metallic shell.

8. An electrical connector comprising:

an elongated insulative housing extending in a longitudinal direction; and a plurality of contacts disposed in the housing along said longitudinal direction, said contacts being categorized with at least first and second groups contacts wherein the first group contacts include differential pairs of signal contacts and the second group contacts include grounding or shielding contacts, said first group contacts and said second group contacts being alternately arranged with each other along said longitudinal direction; wherein a first distance defined by an inner pitch of each differential pair of the first group contacts is larger than a second distance defined by an outer pitch between each of the first group contacts and each of the second group contacts adjacent thereto;

wherein said first distance is twice of the second distance;

wherein the housing defines a plurality of passageways to receive the corresponding first group contacts and the second group contacts respectively.

9. The electrical connector as defined in claim 8, wherein some of said second group contacts are electrically connected to a metal shield enclosing the housing.

10. The electrical connector as defined in claim 8, wherein said both said first distance and said second distance are invariable.

11. The electrical connector as defined in claim 8, further includes third group contacts each disposed between every corresponding differential pair of the first group contacts.

12. The electrical connector as defined in claim 8, wherein the housing further defines a dummy passageway between each differential pair while without receiving any contact therein.

* * * * *